US006881180B2

(12) United States Patent
Ammons et al.

(10) Patent No.: US 6,881,180 B2
(45) Date of Patent: Apr. 19, 2005

(54) APPARATUS FOR FORMING A BOTTOM CLOSURE FOR A CONTAINER

(75) Inventors: Kimberly D. Ammons, Cedar Rapids, IA (US); Roderick W. Kalberer, Cincinnati, OH (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/444,170

(22) Filed: May 23, 2003

(65) Prior Publication Data

US 2004/0005978 A1 Jan. 8, 2004

Related U.S. Application Data

(60) Division of application No. 09/798,597, filed on Mar. 2, 2001, now Pat. No. 6,599,225, which is a continuation-in-part of application No. 09/425,875, filed on Oct. 23, 1999, now abandoned.

(60) Provisional application No. 60/105,857, filed on Oct. 27, 1998.

(51) Int. Cl.[7] ..... B31B 1/50

(52) U.S. Cl. ..... 493/183; 493/218; 493/225; 493/260

(58) Field of Search ..... 493/183, 190, 493/218, 225, 245, 165, 260, 80; 53/376.6, 376.8; 220/62; 229/184, 915.1

(56) References Cited

U.S. PATENT DOCUMENTS

| | | | | |
|---|---|---|---|---|
| 3,789,746 | A | 2/1974 | Martensson et al. | |
| 3,999,469 | A | * 12/1976 | Nilsson | 493/164 |
| 4,078,364 | A | 3/1978 | Schmidt | |
| 4,124,159 | A | 11/1978 | Schwarzkopf | |
| 4,192,446 | A | 3/1980 | Naito | |
| 4,428,177 | A | 1/1984 | Focke et al. | |
| 4,540,116 | A | 9/1985 | Shirakawa | |
| 4,583,678 | A | 4/1986 | Weimer, Jr. | |
| 4,667,873 | A | 5/1987 | Yasui et al. | |
| 4,702,410 | A | 10/1987 | Derving | |
| 4,732,275 | A | 3/1988 | Hambleton et al. | |
| 4,903,891 | A | 2/1990 | Gordon | |
| 5,120,292 | A | 6/1992 | Ueda et al. | |
| 5,366,433 | A | * 11/1994 | McCormick | 493/38 |
| 5,456,646 | A | 10/1995 | Crowley | |
| 5,484,374 | A | 1/1996 | Bachner et al. | |
| 5,555,708 | A | 9/1996 | Shower et al. | |
| 5,626,285 | A | 5/1997 | Tedford, Jr. et al. | |
| 5,636,785 | A | 6/1997 | Kalberer et al. | |
| 5,867,966 | A | 2/1999 | Mogard | |

* cited by examiner

*Primary Examiner*—Sameh H. Tawfik
(74) *Attorney, Agent, or Firm*—Melvin D. Fletcher

(57) ABSTRACT

A method and apparatus for forming a bottom closure of a container employing multiple assembly lines and including a universally foldable seal fin as a part of the bottom closure. A novel blank for the container is disclosed.

3 Claims, 8 Drawing Sheets

APPARATUS FOR FORMING A BOTTOM CLOSURE FOR A CONTAINER

CROSS-REFERENCE TO RELATED APPLICATIONS

This application is a divisional application of application Ser. No. 09/798,597, filed Mar. 2, 2001, now U.S. Pat. No. 6,599,225, entitled: METHOD AND APPARATUS FOR FORMING A BOTTOM CLOSURE FOR A CONTAINER EMPLOYING A UNIVERSAL FIN BOTTOM CLOSURE AND BLANK EMPLOYED THEREWITH, which is a continuation-in-part application of Ser. No. 09/425,875, filed Oct. 23, 1999, now abandoned, entitled: IMPROVED GABLE TOP FILLING MACHINE, which is a non-provisional application claiming priority of provisional application Ser. No. 60/105,857, filed Oct. 27, 1998, entitled: IMPROVED GABLE TOP FILLING MACHINE AND METHOD OF FORMING CARTON BOTTOM.

STATEMENT REGARDING FEDERALLY SPONSORED RESEARCH OR DEVELOPMENT

Not Applicable

BACKGROUND OF THE INVENTION

This invention relates particularly to packaging for consumer goods which are pourable from a paperboard container through a pour spout located adjacent the top end of the container. Products such as milk and juices are commonly packaged in such prior art containers. Certain consumer products, such as, edible oils, laundry detergent or lubrication oils may not be packaged in prior art containers due to their tendency to leak through the bottom closure employed in prior art paperboard containers.

The packages of the present invention relate to, and are described herein with reference to, the well-known gable top container, but other containers of generally rectangular cross-section are encompassed within certain aspects of the present invention. These containers are commonly formed from a laminate, such as paperboard onto whose opposite surfaces a layer of heat sealable polymeric material has been extruded. Thus, in the present invention, both outer surfaces of the container include a heat sealable polymeric coating.

Existing production facilities for gable top containers commonly include an assembly line type production facility. In this assembly line a side-seamed container blank which is initially folded flat is fed into the assembly line. This blank is initially expanded into an open-ended tubular configuration and thereafter fitted over one of a plurality of mandrels which extend radially from a central drive shaft. Through control of the drive shaft, these mandrels, with their respective blanks, are indexed between various container-forming stations to ultimately define a container having a closed bottom end. This closed-end container is passed from its mandrel onto a conveyor which carries the container to and through a filling station and a top closure station. The functions of closing the top and bottom ends of a gable top container require that the container blank be oriented such that as it is passed through the machinery, its fold lines are properly aligned with the folding equipment of the assembly line. Specifically, in the prior art gable top container assembly line, the uppermost fin of the gable top must be oriented with the direction of movement of the container through the assembly line. Further, the prior art designs for the bottom closure of the container require that specific panels, tabs or flaps provided on the bottom ends of the side panels of the container be folded only in accordance with a single sequence. In these bottom closures, the folding sequence had a "handness", that is, the bottom closure forming equipment requires that the container be aligned in only one acceptable attitude or else the bottom closure can not be effected. Thus, in the prior art container assembly lines, the orientation of the top closure equipment and the orientation of the bottom closure equipment must be coordinated to accommodate each other.

Of recent, gable top containers have been provided with a pour spout affixed to one of the inclined top side panels of the container in flow communication with a through-opening which is pre-cut in one of the top panels of the container. The prior art assembly line equipment has been retrofitted with equipment suitable for affixing of the pour spout to the container by installing the necessary equipment within the existing assembly line downstream of the formation of the closed bottom of the container and the container filling station. The known equipment for affixing a pour spout to a container requires that the pre-cut hole for the pour spout be oriented on that side of the container which faces laterally outwardly of the direction of movement of the container along the assembly line. This requirement is dictated by reason of the physical space required to position to the pour spout-affixation equipment such that there is access to the through-opening in the top end of the container for placement of the pour spout and its affixation to the container.

In the prior art, efforts to increase the productivity of the machines employed to form and fill containers having included the concept of combining at least a second assembly line in generally parallel relationship to a first assembly line and using common housing, sterilization systems, drive systems, etc. for the two lines. These prior multiple assembly lines could employ identical container-forming and filling equipment on each line because the orientation of the container being fed into and through each of the lines could be the same for each line.

With the advent of pour spouts, because the pour spout affixation equipment must be positioned laterally outboard of each of the assembly lines of a dual assembly line arrangement, the container blanks being fed into the assembly lines must be oriented as mirror images of one another so that the through-opening for the pour spout of each container blank is facing laterally outwardly of the direction of movement of the blanks along each of the assembly lines and therefore accessible to the pour spout affixation equipment associated with a respective line. This required orientation of the container blanks requires minimal alteration of the equipment of each assembly line. First, it dictates that the mandrel carousel of each assembly line of a dual assembly line arrangement be substantially a mirror image of the mandrel carousel of the other of the assembly lines. When changing a prior art mandrel carousel from "left-handness" to a "right handness", that is, when converting two mandrel carousels of the prior art into mirror images of one another, one must make changes in one of the carousels including (a) rotating the oven heater head in the first forming (and heating) station by 180 degrees; and (b) rotating the pressure pad employed in the sealing of the panels of a bottom closure by 180 degrees. Moreover, such a change requires an inventorying of two differing sets of replacement parts for the mandrel carousels.

It is therefore an object of the present invention to provide a universal bottom closure design for use in the forming and filling of gable top containers having pour spouts.

It is another object to provide a method and apparatus for forming and filling of gable top containers having pour spouts.

It is another object to provide a container blank for use in the forming of a gable top container which includes a pour spout.

It is another object to provide a pressure pad for use on the distal end of a carousel mandrel in the forming of the bottom closure of a gable top container which includes a pour spout.

BRIEF SUMMARY OF THE INVENTION

In accordance with one aspect of the present invention, there is provided a method for the forming and filling of pour spout-containing containers of the gable top variety employing multiple assembly lines having various of the components thereof common to all the lines, such as the drive, housing, sterilization system, etc. Apparatus for carrying out the method is disclosed, as is a novel container blank which is universal with respect to its acceptability on either of the multiple assembly lines, especially with respect to its bottom closure design.

DETAILED DESCRIPTION OF THE INVENTION

Figure 2:
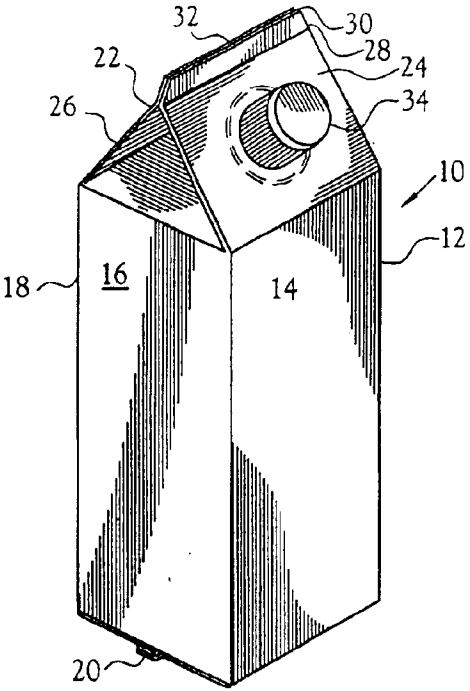
FIG. 2 is a perspective representation of one embodiment of a gable top container embodying a pour spout and a bottom closure embodying various of the features of the present invention.

Referring initially to FIG. 2, a typical gable top container contemplated in the present invention includes four side panels 12,14,16, and 18, a closed bottom 20 and a closed top 22. The top 22 of the container includes first and second sloping side panels 24,26 whose outboard ends 28,30 are sealed together to define a fin 32 that extends between opposites ones of the sides of the container. A pour spout 34 is affixed to one of the sloping panels 24 to provide a means through which the contents of the container may be emptied.

Figure 1:
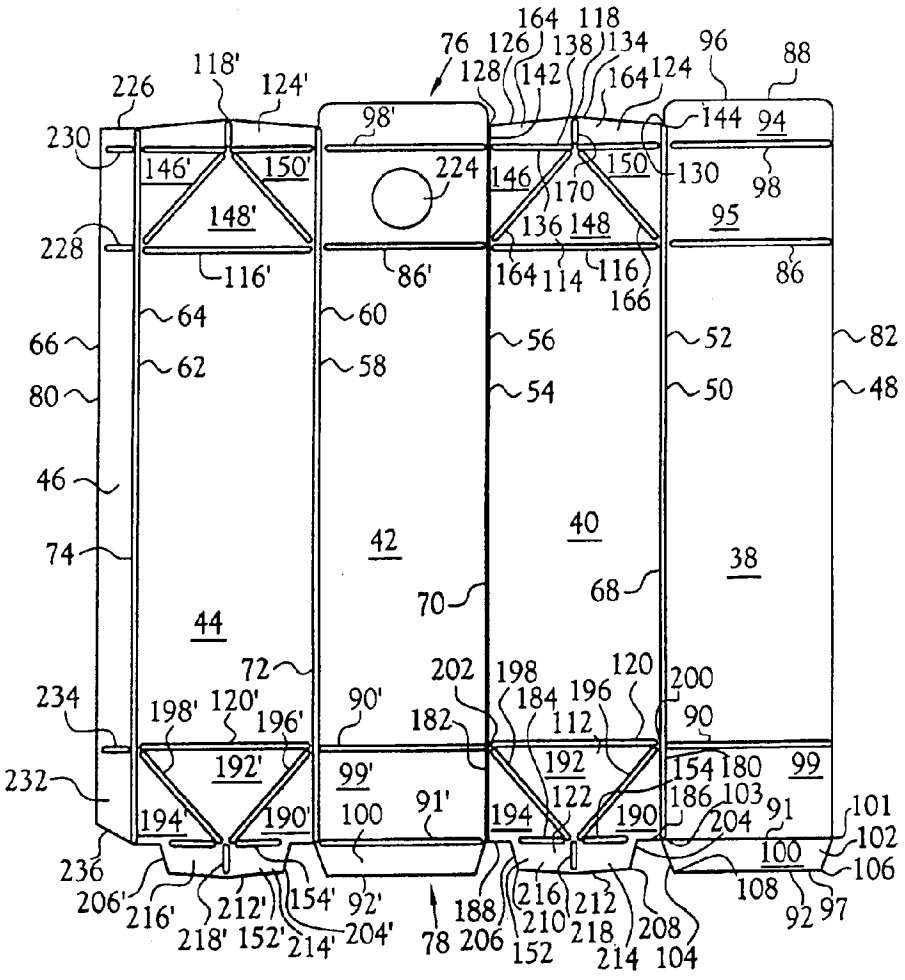
FIG. 1 is a laid-out view of a container blank embodying various of the features of the present invention.

With reference to FIG. 1, the depicted embodiment of the inside surface of a container blank 36 of the present invention comprises first, second, third, fourth and fifth side panels 38,40,42,44 and 46, respectively. Each of these side panels includes opposite side edges 48 and 50, 52 and 54, 56 and 58, 60 and 62, and 64 and 66, respectively. The side edges 50 and 52 are common to the first and second panels, the side edges 54 and 56 are common to the second and third panels, the side edges 58 and 60 are common to the third and fourth panels, and the side edges 62 and 64 are common to the fourth and fifth panels, and are defined by longitudinal fold lines 68,70,72 and 74, respectively, each of which extends between the top and bottom ends 76,78 of the blank. To form an open-ended tubular blank of rectangular configuration, the several panels are folded along their longitudinal fold lines, with the outside surface 80 of the fifth panel underlying a portion of the inside surface 82 of the outside margin 84 of the first panel and being sealingly bonded thereto.

As depicted in FIG. 1, at the top end 88 of the first panel 38, first and second fold lines 86 and 94, in combination with the top edge 96, all of which extend generally orthogonally between the opposite side edges 48,50 of the first panel at different spaced apart distances from the top end of the first panel, define a generally rectangular foldable panel 95 and a generally rectangular first foldable flap 95. At the bottom end 92 of the first panel, third and fourth fold lines 90 and 91, extending generally orthogonally between the opposite side edges 48,50 of the first panel at different spaced apart distances from the bottom end of the first panel, in combination with the bottom edge 97 of the first panel, which is substantially parallel to these fold lines, define a generally rectangular foldable panel 99 and a trapezoidal foldable flap 100. Notably, this foldable flap includes opposite side edges 102 and 104, each of which extends obliquely inward of the foldable flap 100 in a direction from its intersection 101, 103, respectively, with respective ones of the opposite side edges 48,50 of the first panel to intersect the opposite ends 106, 108 of the outermost side edge 97 of the foldable flap 100. Also notably, the bottom edge 97 of the flap 100 is centered with respect to the longitudinal centerline of the first panel 38.

Continuing to refer to FIG. 1, at the top end 118 of the second panel 40, first and second fold lines 116 and 138, both of which extend generally orthogonally between the opposite side edges 52,54 of the second panel at different spaced apart distances from the top end of the second panel, in combination with portions of the sides edges 52,54 of the second panel, define a generally rectangular foldable panel 114. Between its outermost fold line 138 and its innermost fold line 116, this foldable panel is subdivided into three generally triangular panels 146,148, and 150 by a first fold line 164 which extends obliquely from proximate the projected intersection 168 of one end of the fold line 164 with the side edge 52 of the second panel, to a location proximate the midpoint of the fold line 138, and a fold line 166 which extends obliquely from proximate the projected intersection of the opposite end of the fold line 116 with the side edge 54 of the second panel, to a location proximate the midpoint of the fold line 138.

A top foldable flap 124 is defined distally of the foldable panel 114. The innermost edge of this foldable flap is common with the fold line 138 of the foldable panel 114. This fold line 138, portions 142 and 144 of the opposite side edges 52,54 of the second panel, and a distal edge 126 define this foldable flap 124. As depicted, the distal edge 126 of the foldable flap 124 includes two segments 170, 172, one segment 170 of which extends obliquely outwardly of the blank between the side edge 52 of the second panel to the midpoint of the length of the distal edge 126. The other segment 172 of the distal edge 126 extends between the side edge 54 of the second panel to the midpoint of the length of the distal edge 126 where it joins the other 170 of the segments. A fold line 140 intersects the foldable flap 114, extending from the midpoint of the distal edge 126 inwardly to proximate the fold line 138 to divide the foldable flap into two panels 164 and 166 which are mirror images of one another.

Referring again to FIG. 1, at the bottom end 122 of the second panel 40, there is defined a bottom foldable panel 112. This panel is partly defined by a fold line 120 which extends generally orthogonally between the opposite side edges 52,54 of the second panel at a spaced apart distance from the bottom end of the second panel, and by portions 180,182 of the sides edges 52,54, respectively, of the second panel. The outermost side 184 of this foldable panel 112 is defined by a central fold line 150 which is aligned with flanking first and second partial end edges 186, 188 of the second panel. Between its outermost side 184 and its innermost fold line 120, this foldable panel is subdivided into three generally triangular panels 190, 192 and 194 by a first fold line 196 which extends obliquely from proximate the projected intersection 200 of one end of the fold line 120 with the side edge 52 of the second panel, to a location proximate the midpoint of the fold line 154, and a second fold line 198 which extends obliquely from proximate the projected intersection 202 of the opposite end of the fold line 120 with the side edge 54 of the second panel, to a location proximate the midpoint of the fold line 154.

A bottom foldable flap 152 is defined distally of the foldable panel 112. The innermost edge of this bottom foldable flap is common with the fold line 154 of the foldable panel 112. The opposite side edges 204,206 of the bottom flap 152 project normally from the projected intersection of the fold line 154 and the first flanking end edge 186 of the second panel and from the projected intersection of the fold line 154 and the second flanking end edge 188 of the second panel. The distal ends 208, 210 of these side edges 204, 206, respectively, are joined together by a distal side edge 212. As depicted, the distal side edge 212 of the bottom foldable flap 152 includes two segments 214, 216, one segment 214 of which extends obliquely outwardly of the blank from the distal end 208 of the side edge 204 of the bottom foldable flap to the midpoint of the length of the distal edge 212. The other segment 216 of the distal side edge 212 extends from the distal end 210 of the side edge 206 to the midpoint of the length of the distal edge 212 where it joins the other 214 of the segments. A fold line 218 intersects the foldable flap 152 extending from the midpoint of the distal edge 212 inwardly to proximate the fold line 150 to divide the foldable flap into two panels 220 and 222 which are mirror images of one another.

As shown in FIG. 1, the third panel 42 is identical to the first panel 38 with the exception that the third panel is provided with a through-opening 224 in the top foldable panel thereof at a location between a fold line 86' and a further fold line 98' of this top panel. Primed numerals are employed in FIG. 1 to designate elements of the third panel which are like the same elements of the first panel.

Further as shown in FIG. 1, the fourth panel 44 is identical to the second panel 40. Again, primed numerals are employed in FIG. 1 to designate elements of the fourth panel which are like the same elements of the first panel.

The fifth panel 46, as depicted in FIG. 1 comprises a relatively narrow panel having its innermost side edge 64 common with the side edge 62 of the fourth panel 42 as defined by a longitudinal fold line 74. The top end 226 of the fifth panel is provided with first and second spaced apart fold lines 228,230 which extend orthogonally substantially between the opposite edges of the fifth panel. The first 228 of these fold lines is located further longitudinally inward of the other 230 of these fold lines. To bottom end 232 of the fifth panel is provided with a fold line 234 which extends orthogonally substantially between the opposite side edges of the fifth panel. The bottom edge 236 of the fifth panel extends obliquely outwardly and upwardly of the innermost side edge 64 of the fifth panel to intersect the bottom end 238 of the outermost side edge 80 of the fifth panel.

As seen in FIG. 1, all of the fold lines 86,116,86',116' and 228 of the several panels are aligned across the overall width of the blank at a common longitudinal level of the blank. The same is true of the fold lines 90,120, 90',120' and 234 of the first through fifth panels, and the fold lines 91,154,91' and 154', of the first through fourth panels.

Figure 3:
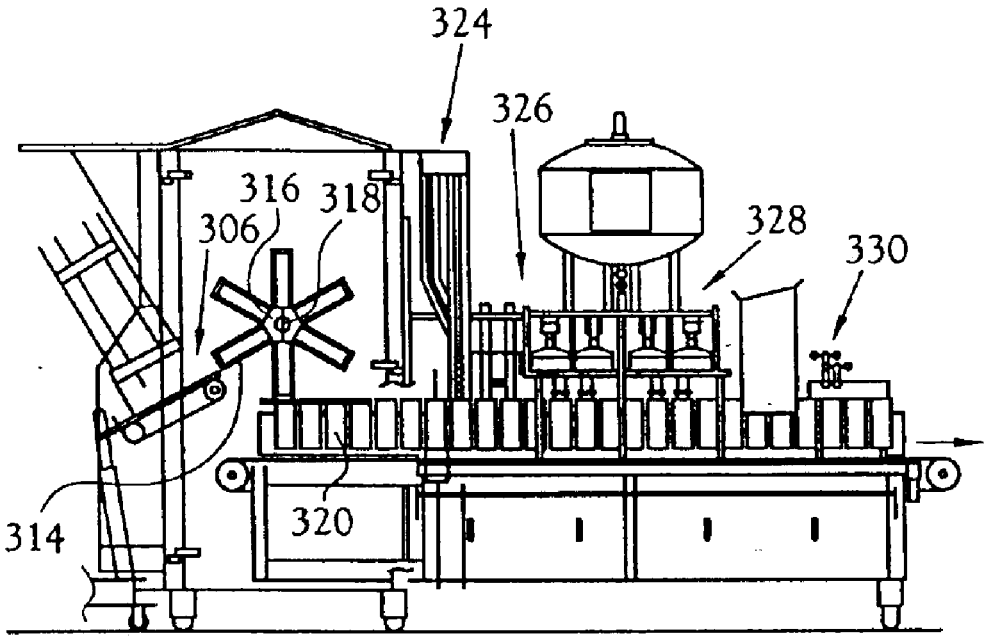
FIG. 3 is a side elevation view of a dual-assembly line for the forming and filling of gable top containers.
Figure 4:
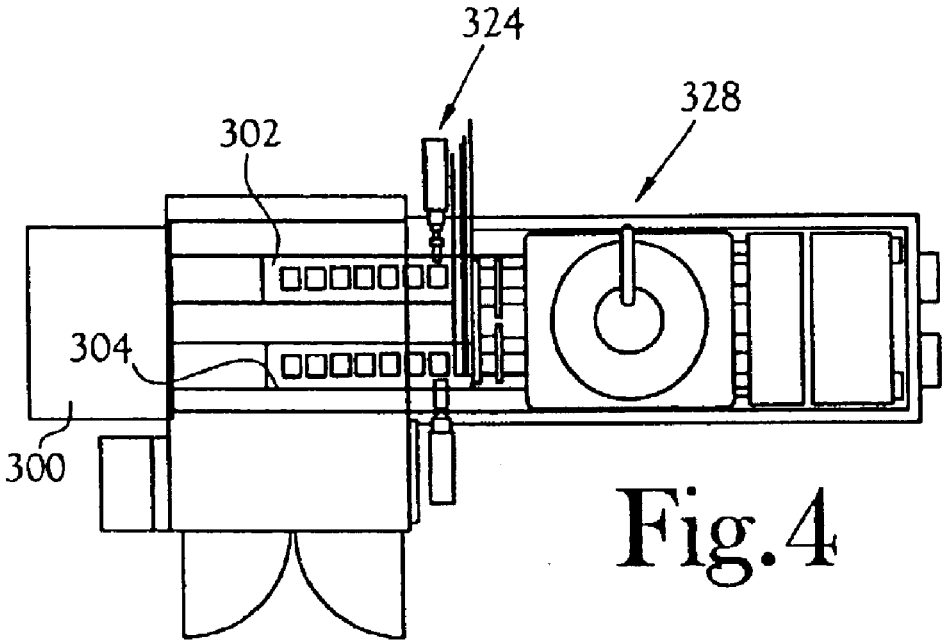
FIG. 4 is a top view of the assembly line depicted in FIG. 3.
Figure 13:
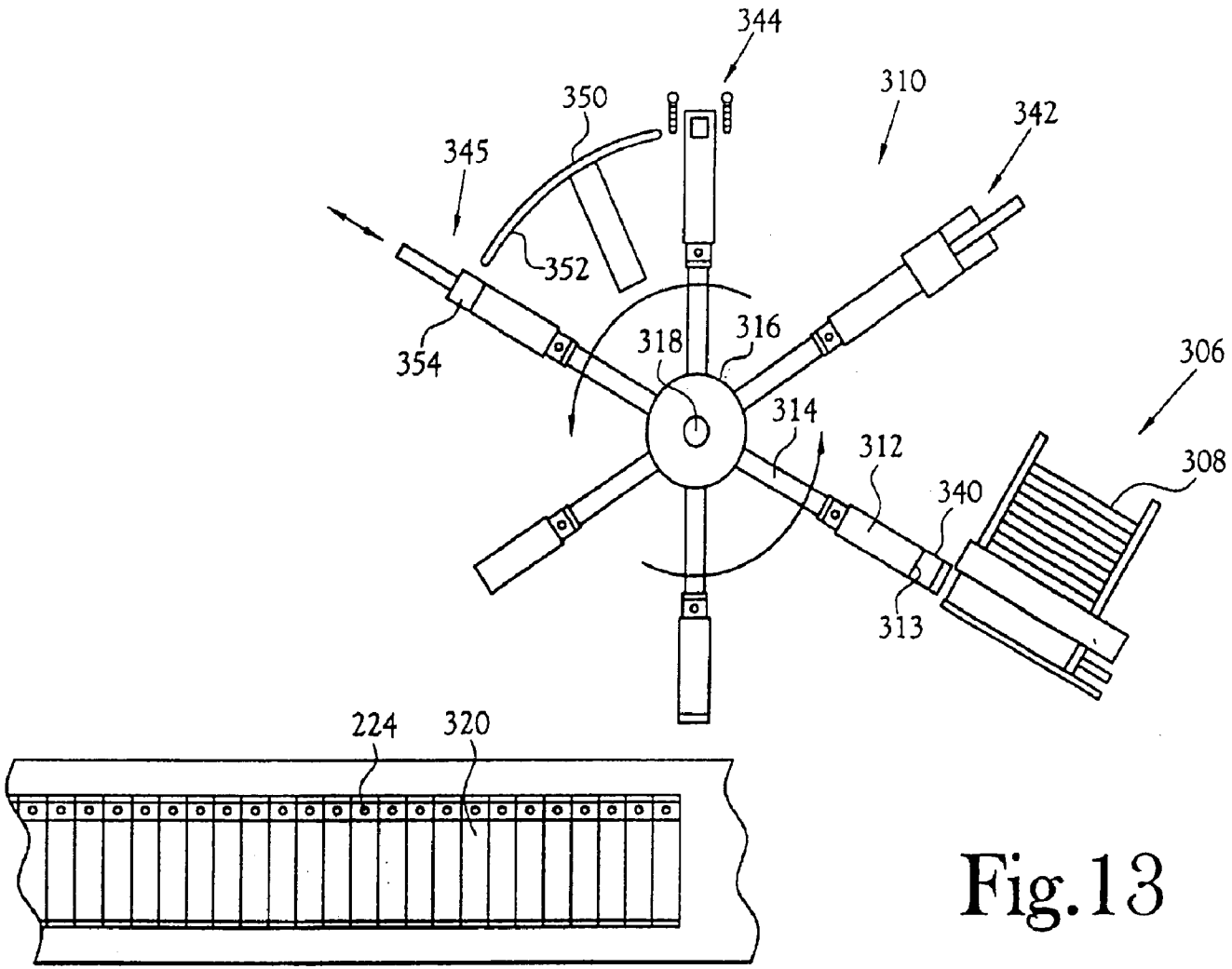

Referring to FIGS. 3,4 and 13, one embodiment of an assembly line type apparatus employing first and second assembly lines for the erection and filling of containers having a pour spout includes a housing 300 which encloses various drive and control elements of the apparatus, each of which is common to two parallel-aligned spaced-apart assembly lines 302,304. Each of the assembly lines includes a feed station 306 (See FIG. 3) which feeds flattened open-ended blanks 308 to a bottom closure forming station 310. Within this bottom closure forming station, each opened blank is fed onto a mandrel 312 (typical) defined by a radial arm 314 of a multi-arm carousel 316 having a central drive axle 318, for transport between multiple forming stations disposed circumferentially about the carousel 316. Following closure of the bottom of the container, the open-top container 320 is deposited on a respective conveyor 302 and transported to a pour spout placement station 324 where a pour spout 34 (FIG. 2) is affixed to the top end of the container. The container thereafter is fed forwardly through a sterilization station 326, thence to a filling station 328 where the container is filled with its desired contents. The filled container is thereafter fed forwardly to a top-closing station 330 where the top end of the container is closed. Filled and closed containers may be collected for storage or transport. The first and second assembly lines are substantially identical to one another, except the pour spout applicator apparatus is disposed outboard laterally of each line, ie., the spout applicators are mirror images of one another. As noted, for purposes of enhanced efficiency of operation, maintenance, parts inventory, floor space, etc., the two assembly lines employ many common components.

Referring to FIGS. 5–11, the bottom folding station includes first and second fingers 346 and 348 which are disposed on respective opposite sides 40 and 44 of the container blank on the mandrel. These fingers are mounted on respective shafts 345 and 347 for reciprocal rotation of the fingers toward and away from their respective sides of the container blank. By reason of their positioning, these fingers serve to inwardly fold those panels associated with the bottom of the sides 40 and 44 which ultimately define first and second gussets 350 and 352. Also within the bottom forming station there are provided first and second folding wings 354 and 356 which are mounted on respective shafts 358, 360 for reciprocal rotation of each wing toward and away from its respective side of the container blank. The first of these wings 354 is operatively disposed adjacent the side 38 of the container blank, and the second wing 356 is operatively disposed adjacent the side 42 of the container blank. The first wing 354 is more narrow in width than the second wing 356. These wings serve to fold inwardly of the container blank those panels which ultimately generally define the external layers of the closed bottom of the container, including the formation of a fin seal and the folding of the fin seal generally flat against the bottom of the container.

In accordance with one aspect of the present invention, as depicted schematically in FIG. 13, the method for the closing of the bottom of each container is effected employing the depicted apparatus and generally while the container is disposed on one of the radial mandrels 314 of the carousel 316. More specifically, after a flattened blank has been opened into a tubular configuration, at a feeding station 306, the blank is fitted onto a mandrel 314 with the bottom end 340 of the blank disposed contiguous to the distal end of the mandrel. In accordance with one aspect of the present invention, the distal end of each mandrel of the carousel 316 defines a smooth flat face 313 that is oriented perpendicular to a radius of the carousel.

As depicted schematically in FIGS. 6–11 and 13, after the blank has been fitted onto a mandrel 312, rotation of the carousel transfers the mandrel and its blank to a first forming station 342 whereat the bottom panels of the open bottom end of the blank are heated to soften a thermoplastic coating disposed on the inner and outer opposite surfaces of the blank. The general construction of the carousel, the construction of its mandrels, and the operation of the carousel in general, are well known in the art and need not be described herein in detail.

Figure 6:
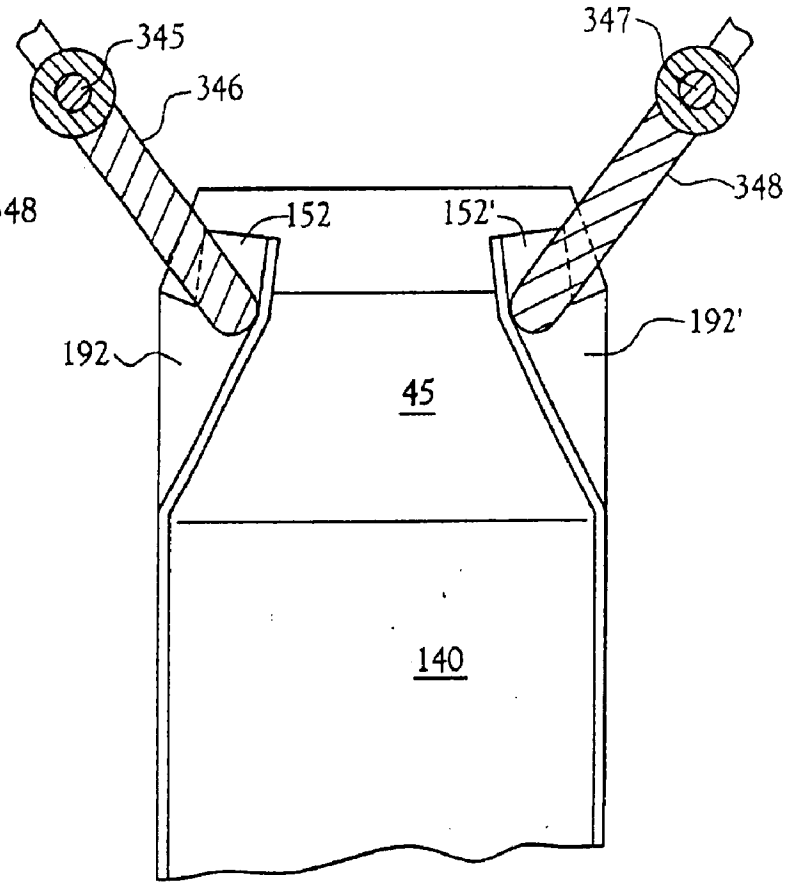
FIGS. 6–11 depict a progression of steps for infolding and forming a bottom closure of the container depicted in FIG. 5.
Figure 5:
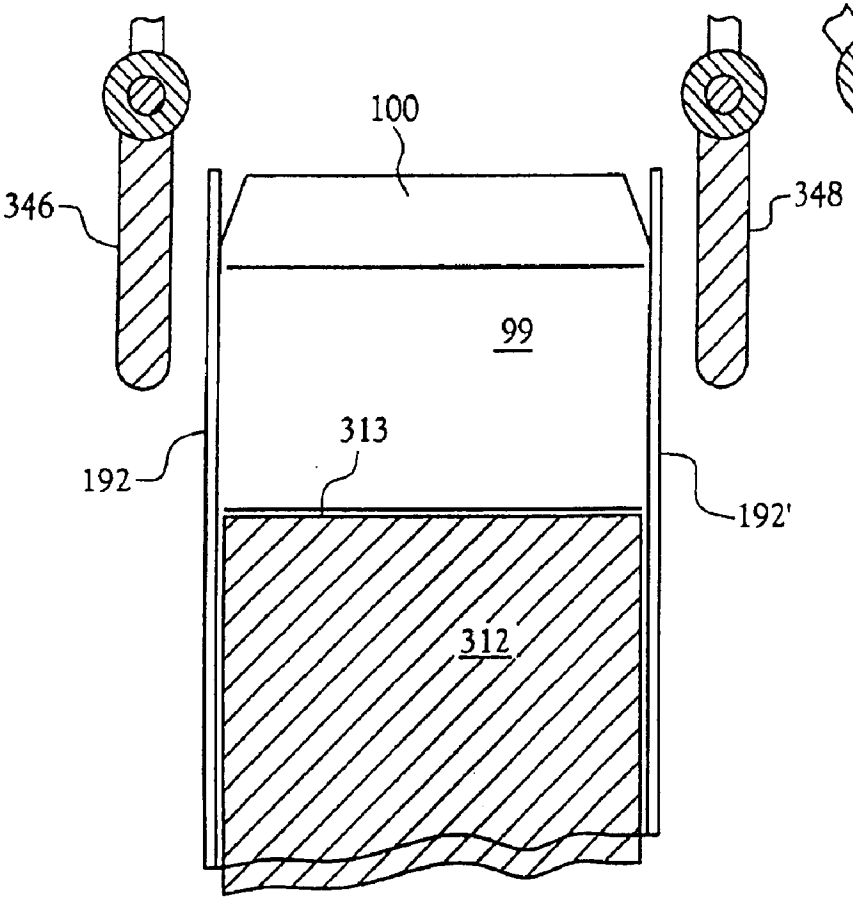
FIG. 5 is a partial view depicting the bottom end of a container and the orientation of the container with respect to one embodiment of apparatus for effecting infolding of the sides of the container to define a bottom closure of the container.
Figure 7:
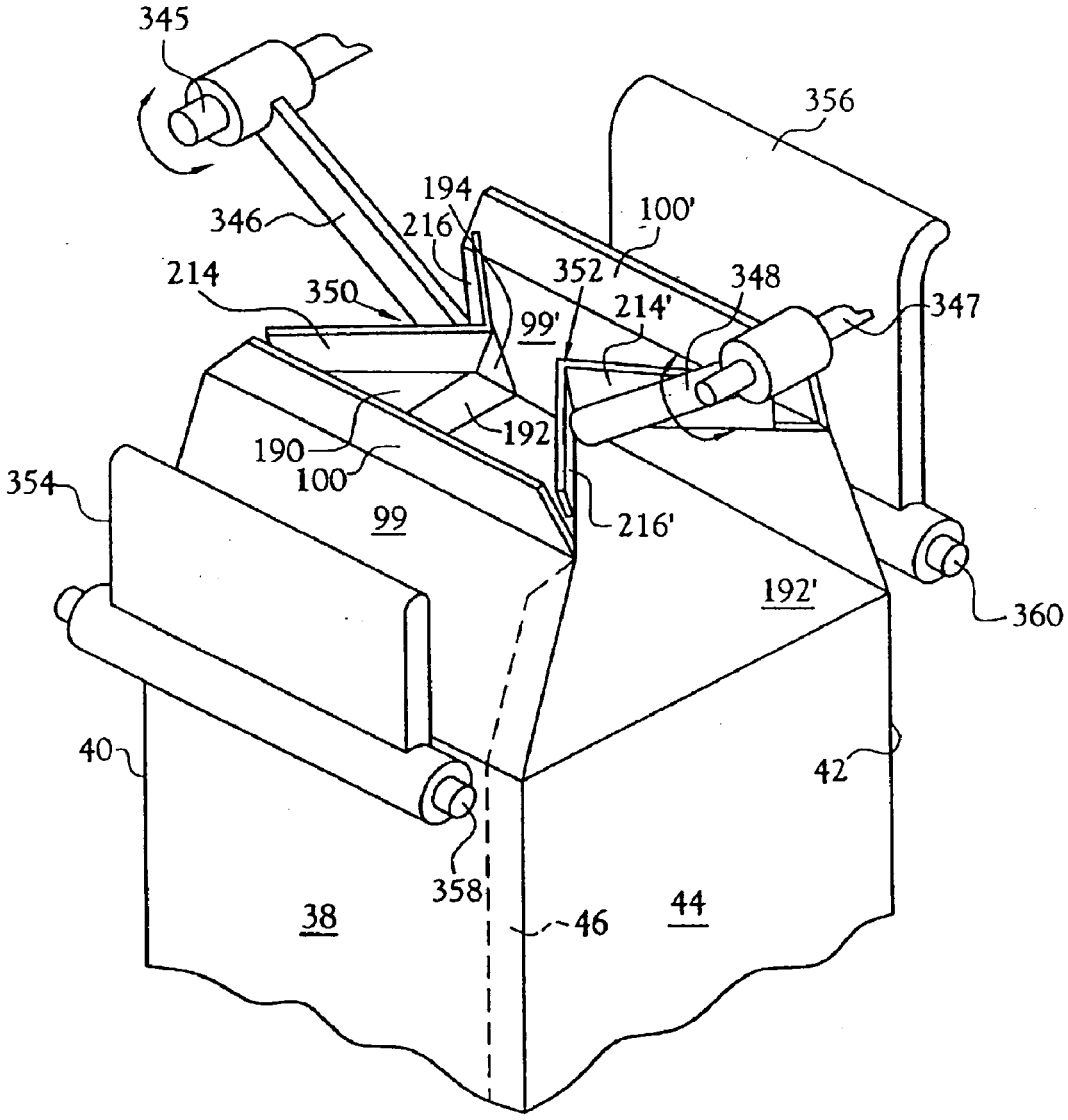
Figure 9:
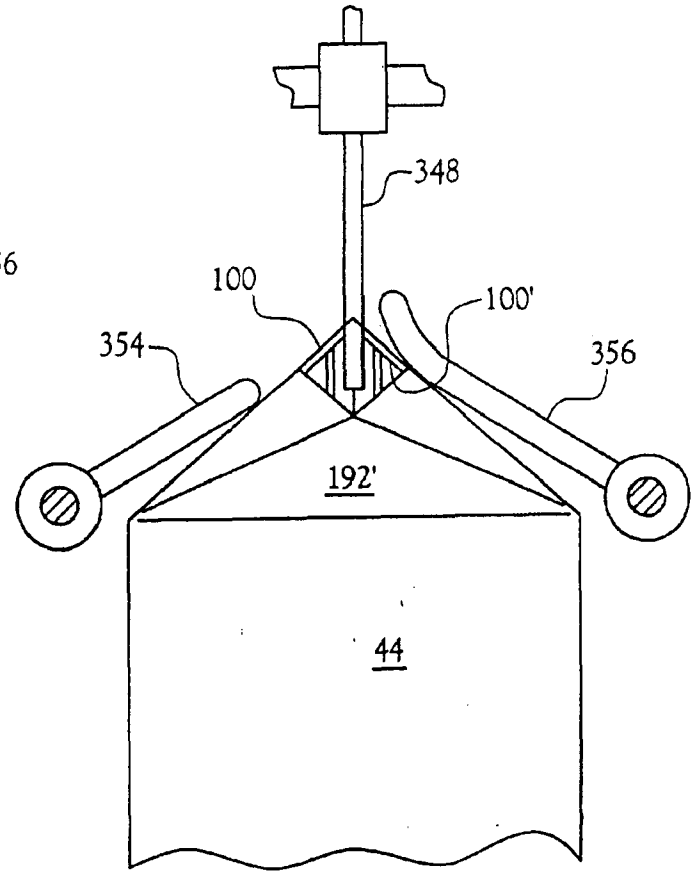
Figure 8:
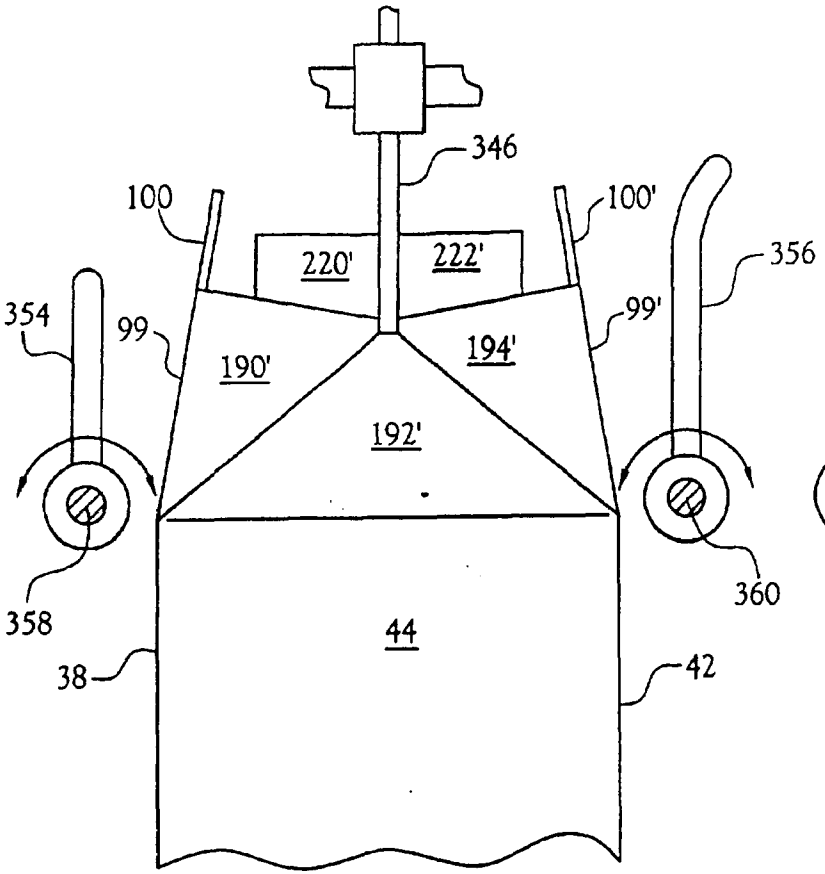
Figure 10:
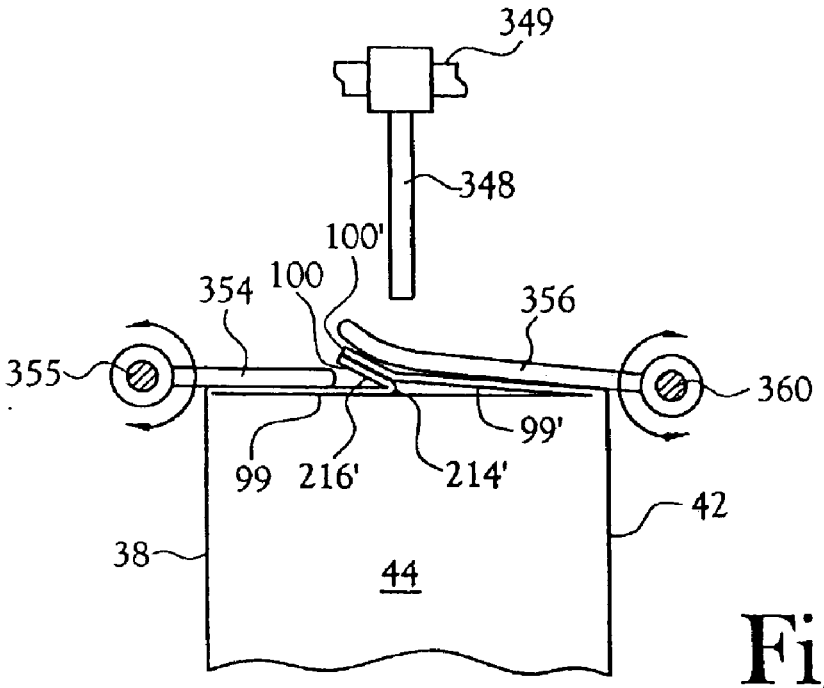

Following removal of the heat source from the blank, the mandrel and blank are rotated to a bottom folding station 344. Referring to FIGS. 5–11, and initially to FIGS. 2 through 4, once the blank is positioned in the bottom folding station 310, rotatable fingers 346,348 are commenced to rotate inwardly, as illustrated in FIGS. 6 and 7, to commence infolding of the panels 192 and 192', and their associated flaps 152 and 152', of the bottom panels of the second and fourth side panels to define end gussets 350 and 352 on opposite sides of the container.

More specifically, at the bottom folding station, the fingers 346 and 348 are rotated about their respective shafts 345,347 to first move into contact with their respective sides 40,44 of the container blank. As the fingers are further rotated, they push on the sides of the container blank proximate the longitudinal midline of each of the sides 40,44 of the blank and start the infolding of the panels 192 and 192' along their fold lines 196 and 198 and 196' and 198', and the infolding of the 218,218' along their respective midpoint fold lines and toward overlying relationship of the segments 212 and 220 of the flaps. This infolding of the panels 192 and 192' also, respectively, serves to commence the infolding of each of the panels 99 and 99' on the sides 38 and 42, respectively, of the blank. These fingers remain in engagement with their respective sides of the blank to temporarily retain the partially folded sides of the blank in their partially folded positions.

While the partially formed gussets 350,352 are retained by the fingers, the wings 354 and 356 are commenced to rotate inwardly toward their respective sides 38,42 of the blank and further to simultaneously further collapse the partially formed gussets. Thereupon, the fingers 346 and 348 are withdrawn from engagement with the blank and to positions separated from the blank to permit further inward rotation of the wings. The wings, thereupon, rotate inwardly of the blank to complete the folding of the panels 99 and 99' inwardly of the blank into the plane of the bottom of the container and simultaneously complete the formation of the gussets 350 and 352, and the folding of the segments 214 and 216 of the flap 152 and the segments 214' and 216' of the flap 152' back upon themselves. As noted from FIGS. 9–11, this further infolding of the panels 99 and 99' also results in capture of the back folded flaps 212 and 212' between the overlying distal panels 100 and 100' of the panels 99 and 99' to define a fin 222 which comprises over portions of the distal flaps of all four sides of the blank. Recalling that the wing 354 is more narrow than the wing 356, the distal edge 221 of the wing 354 terminates short of the lateral centerline 223 of the bottom of the blank (see FIG. 11) when the wing is fully rotated inwardly of the bottom of the blank. This positions the distal edge 221 of this wing 354 adjacent the lateral centerline 223, but spaced apart therefrom by a distance approximately equal to the width of the flap 100' of the side panel 42 of the blank. Further, the timing of the rotation of the first and second wings is chosen such that the first wing 354 rotates ahead (in time) of the second wing 356 and therefore assumes its fully inward limit of rotation prior to the second wing 356 assuming its fully inward limit of rotation. The width of the second wing 356 is equal to approximately the combined width of the panel 99' and its associated flap 100' of the side panel 42 of the blank so that as this second wing is rotated inwardly of the blank, and behind, in time, the rotation of the first wing 354, the flap 100' of the panel 99' of the side panel 42, and the folded flap 152' of the side panel 44, underlie the distal margin 225 of the second wing 356. As the second wing 356 in rotated toward its most inward limit of travel, the flap 100' is caused to engage and overlie the flap 100 of the panel 99 of the side panel 38. Further rotation of the second wing inwardly of the blank functions to fold the overlying flaps 100 and 100' generally flat and generally within the plane of the bottom of the blank. This folding sequence also serves to capture the respective layers of the two gussets and their overlying flaps 152, 152' between the wings and the flat distal face 313 of the mandrel which holds the blank. Moreover, rotation of the second wing 356 to its most inward limit of rotation serves to fold the fin 222 back upon the outer surface 355 of the panel 99 to thereby position the internal layers of the fin adjacent to one another and/or to the outer layers of the fin, as may be the case. In one embodiment, the distal margin of the second wing is bent out of the plane of the wing in a direction away from the blank. This geometry of the wing precludes the overlying flaps 100 and 100' from becoming bonded to one another or to the outer surface of the panel 99 of the side panel prior to their being pressed into their desired final position for sealing.

Following the infolding of the several panels of the bottom of the blank in the bottom folding station, 344 the mandrel and its blank is indexed to a pressure sealing station 345 (FIG. 13). Between the bottom forming station and the pressure sealing station, there is provided a ski plate 350. This ski plate is provided with a concave smooth surface 355 facing inwardly of the carousel and spaced along the outer limit of the circumferential path of the distal ends of the mandrels of the carousel such that as the folded panels of the bottom of the blank leave the bottom folding station, these folded panels engage the surface 352 of the ski plate and slide there along until the blank reaches the pressure sealing station, thereby precluding the folded panels from moving out of their folded positions during this transfer operation.

Within the pressure sealing station 345, the folded panels of the bottom of the blank are captured between the distal face 313 of the mandrel and a cooled external pressure plate 354. Pressure is applied against the captured folded panels of the bottom of the blank in a direction parallel to a radius of the carousel, to press together selected areas of the folded panels and flaps which define the bottom of the blank, and to effect sealing to one another of the overlying panels, flaps, etc. The applied pressure is maintained for a time sufficient to cool the heat sealable material of the container to its solidification temperature, to thereby effect bonding of at least selected portions of overlying ones of the panels and flaps which define the bottom of the blank, and closing of the bottom of the container. Thereafter, the container is withdrawn from its mandrel and conveyed to further operations.

It is noted that in accordance with one aspect of the present invention, the folding of the distal flaps 152 and 152' back upon themselves along their respective midpoint fold lines 218, 218' positions the outer surfaces (which bear thermoplastic material) of their respective segments 214,216 and 214',216' in facing relationship so that the panels 214,216 and 214',216' may subsequently be bonded together. Moreover, the opposite ends of each of the distal flaps 152 and 152' terminate short of the corresponding opposite ends of the flaps 100 and 100' of the panels 99 and 99' so as to reduce the thickness of the fin, and enhance the sealability of the opposite overlying ends of the distal panels 100 and 100' of the fin. Further, as may be seen from FIG. 1, the sides 204,206 of the panel 152 and the sides 204',206' of the panel 152' are angled so that when the segments panels 152 and 152', are folded back upon themselves and captured between the distal flaps 100, 100', their sides 204,206 and 204',206' assume a straight line, thereby assuring that the segments 214,216 and 214',216' are disposed fully inside the overlying distal flaps 100,100' and providing for a portion of each of the side edges of each of the flaps 100, 100' to extend beyond the distal side edges of the panels 152 and 152' for full enclosure of these panels and good sealing of the fin layers and the fin itself to the outer surface 355 of the panel 99. This full capture of the segments 214,216 and 214'216' within the fin is further ensured by the angle incorporated into the outer side of each of the panels 152 and 152' which provides for the width of these panels adjacent their respective side edges 204,206 and 204'206' to be less than the width of the distal flaps 100 and 100' as may be seen in FIG. 1.

Figure 11:
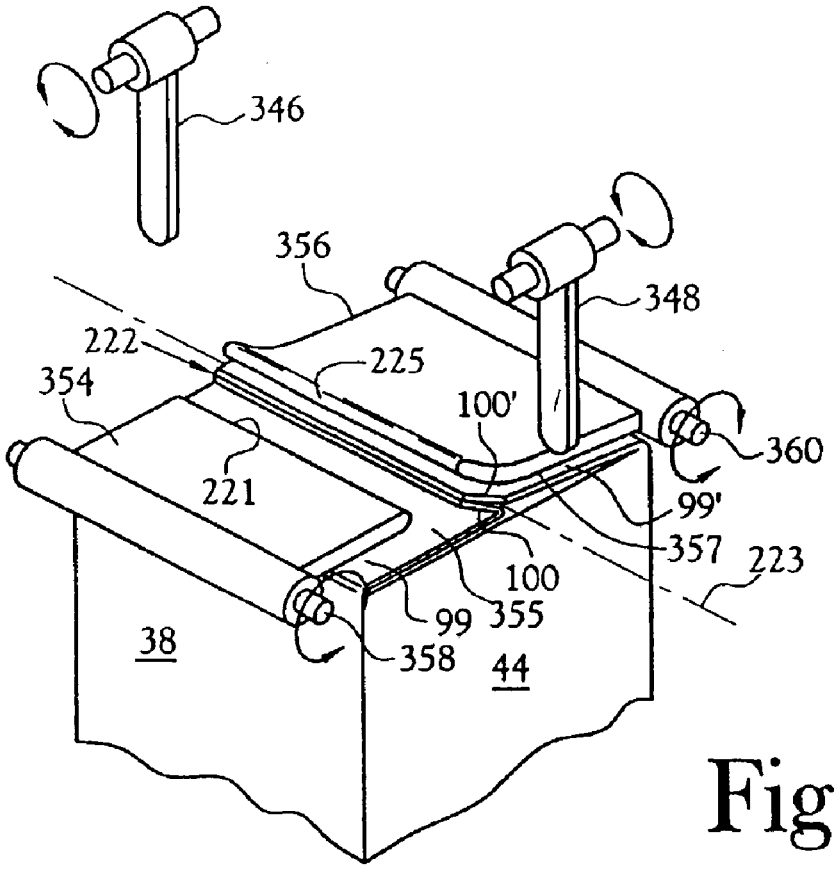
Figure 12:
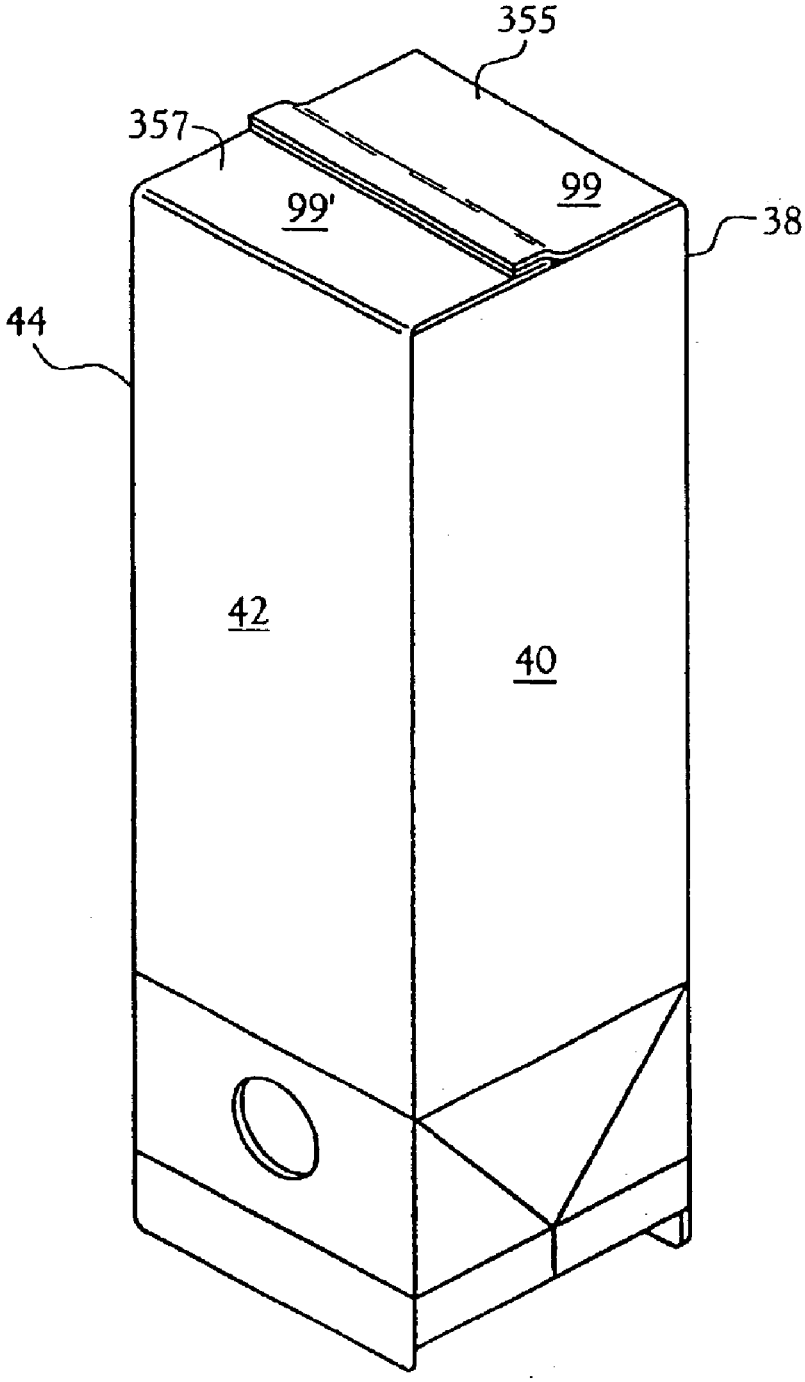
FIG. 12 depicts a fully closed bottom of the container depicted in FIG. 5 and the orientation of the final fold of the bottom closure with respect to a through-opening in the top end of the container for receiving a pour spout; and, FIG. 13 is a schematic representation of a mandrel carousel employed in the forming of a bottom closure of a container such the container depicted in FIG. 2.

In accordance with the present invention, the fin 222 of the bottom closure may be folded back against the outer surface 355 of the panel 99 as depicted in FIG. 11, or it may alternatively be folded back against the outer surface 357 of the panel 99' as depicted in FIG. 12. Thus, when operating two assembly lines side-by-side, all of the tooling associated with the carousels of each of the two assembly lines may be identical and without "handness" in the same manner as many of the other common components of the two assembly lines, and therefore interchangeable from one line to another line of a dual line assembly line, thereby requiring the manufacture and inventorying of only one set of tooling.

As noted hereinbefore, in a dual line container assembly system in accordance with the present invention, because of the volume of space required for a spout fitment applicator, it is necessary that this subassembly be disposed to the outside of its associated assembly line. This requires that the spout opening of a folded container be facing outwardly of its assembly line and therefore in position for the insertion of a fitment. Under these operating conditions, the fifth sealing panel 46 of each formed container, as the formed container is fed forwardly through a first one of the dual assembly lines, will be oriented 180 degrees from the fifth sealing panel of the container which is formed and fed forwardly through the second of the dual assembly lines. To accommodate this reorientation of the fifth sealing panel, it is required that the heater heads in the first forming station and the pressure pad in the pressure sealing station of the second line be rotated 180 degrees with respect to the orientation of the heater head and the pressure pad of the first line. Moreover, depending upon which direction the fin formed on the bottom of the container is folded (ie., toward or away from the side of the container which carries the pour spout), the placement of the wings 354 and 356 are to be positioned relative to one another such that the more narrow one 354 must be positioned on that side of the container toward which the fin is to be folded.

Whereas the present invention has been described with particularity and in connection with the accompanying Figures, it will be understood by one skilled in the art that various alternative constructions and functions may be substituted into the present disclosure without varying from the scope of the invention.

What is claimed is:

1. Apparatus for the closing of a bottom end of a tubular container formed from a paperboard preform having a first pair of opposing end wall portions, each of said first pair of opposing end wall portions including a gusset-formable panel, wherein said gusset-formable panels oppose one another when said preform is erected into a container, said first and second gusset-formable panels having substantially identically dimensioned geometries and each including a flap foldably joined to a portion of the distal side thereof and terminating at its opposite ends short of the opposite ends of its respective one of said first and second gusset-formable panels and projecting outwardly of the bottom of the container prior to the commencement of the infolding of said first pair of end wall portions, and a second pair of end wall portions including first and second generally flat planar panels which oppose one another when said preform is erected into a container, said first and second planar panels having substantially identically dimensioned geometries, each of said first and second end wall portions, including a flap foldably joined to the distal edge of its respective planar panel and extending substantially between the opposite sides of a respective planar panel and projecting outwardly of the bottom of the container prior to the commencement of the infolding of said second pair of end wall portions, said perform being disposed on a mandrel having a flat distal face, the second and fourth sides thereof being opposite one another and the top end of said third side including an opening therethrough for receipt of a pour spout comprising first and second arms, each arm having first and second opposite ends, said first end of said first arm being mounted for pivoting about a first axis and having its second and distal end disposed adjacent said second side panel of said container, said first end of said second arm being mounted for rotation about a second axis and having its second and distal end disposed adjacent said fourth side panel of said container, each of said second and distal ends of said arms being positioned relative to their respective side panels of said container for the application of pressure against their respective side panels of the container preform in a direction inwardly of said container preform to infold the bottom ends of said second and fourth side panels in the form of respective first and second gussets, first and second substantially planar wings, each wing having first and second opposite side edges, said first side edge of said first wing being pivotally mounted about a third axis and having its second side edge disposed adjacent the bottom end of said first side panel and in position to bear against said bottom end of said first side panel to urge said bottom end of said first side panel inwardly of said container and into overlying relationship to said first gusset formed by the action of said first arm and said bottom end of said first side panel, said first side edge of said second wing being pivotally mounted about a fourth axis and having its second and distal side edge disposed adjacent the bottom end of said third side panel and in position to bear against said bottom end of said third side panel to urge said bottom end of said third side panel inwardly of said container and into overlying relationship to second gusset one of said first and second wings having a width dimension between its respective first and second side edges that is less than the width dimension between the first and second side edges of the other of said first and second wing whereby when said wings are rotated into respective positions that are generally coplanar with the partly formed bottom closure of said container, there is defined between said second ends of said flaps an open space.

2. The apparatus of claim 1 wherein said container preform includes a fold line defined on each side panel at a location adjacent its bottom end and only that portion of each of said side panels which is on the distal side of a fold line is infolded by the pivotal action of said arms and said wings.

3. The apparatus of claim 2 wherein each of said axes of rotation of said arms and said wings is disposed orthogonally of the length dimension of respective ones of said side panels of said container preform.

* * * * *